US005753602A

United States Patent [19]

Hung et al.

[11] Patent Number: 5,753,602

[45] Date of Patent: May 19, 1998

[54] CHLORINE CLEANSER TABLETTING PROCESS AND PRODUCT

[75] Inventors: Hin Cheung Hung, Holmdel; Ronnie Albert Carroll, Fair Lawn; Kenneth James Ward, Basking Ridge, all of N.J.

[73] Assignee: The Block Drug Company, Jersey City, N.J.

[21] Appl. No.: 574,052

[22] Filed: Dec. 18, 1995

[51] Int. Cl.[6] ..... C11D 17/04

[52] U.S. Cl. ..... 510/192; 252/186.36; 252/186.37; 252/186.34; 252/186.35; 510/379; 510/380

[58] Field of Search ..... 510/192, 379, 510/380; 252/186.36, 186.37, 187.24, 187.28, 187.33, 187.34; 424/66.1, 76.7, 468; 514/241

[56] References Cited

U.S. PATENT DOCUMENTS

| | | | |
|---|---|---|---|
| 4,043,391 | 8/1977 | Jeffrey et al. | 252/93 |
| 4,269,723 | 5/1981 | Barford et al. | 252/106 |
| 4,281,421 | 8/1981 | Nyquist | 4/228 |
| 4,460,490 | 7/1984 | Barford et al. | 252/92 |
| 4,557,926 | 12/1985 | Nelson | 424/19 |
| 4,560,766 | 12/1985 | Girard | 548/311 |
| 4,680,236 | 7/1987 | Bunczk et al. | 252/174 |
| 5,043,090 | 8/1991 | Camp et al. | 252/106 |
| 5,178,787 | 1/1993 | Hung et al. | 252/90 |
| 5,205,955 | 4/1993 | Bunczk et al. | 252/102 |
| 5,336,427 | 8/1994 | Bunczk et al. | 252/104 |
| 5,342,550 | 8/1994 | Burke et al. | 252/548 |
| 5,562,850 | 10/1996 | Woo | 510/151 |
| 5,578,559 | 11/1996 | Dolan | 510/192 |

*Primary Examiner*—Margaret Einsmann
*Attorney, Agent, or Firm*—Craig M. Bell; Dann, Dorfman, Herrell and Skillman

[57] ABSTRACT

An improved process for the compression and tabletting of solid sustained release toilet bowl cleaners comprises the addition of a small amount of an anionic surfactant which produces a suitably compressed tablet with controlled rates of dissolution for long term cleaning efficacy. The surfactant allows for the formation of more tightly compressed tablets which require less compression energy expenditures reducing the wear and tear on commercial large scale tabletting machines.

11 Claims, No Drawings

CHLORINE CLEANSER TABLETTING PROCESS AND PRODUCT

FIELD OF THE INVENTION

The present invention relates generally to solid toilet bowl and lavatory cleaners and processes for their manufacture. More particularly, the present invention relates to improvements in the manufacture of said cleaners and the resulting improved product.

BACKGROUND OF THE INVENTION

One well-recognized source of germs in modern households is the toilet. Consumers spend considerable time and money in cleaning and sanitizing toilets. Not only is this difficult task unpleasant for many people, it also does not protect against the proliferation of germs between cleanings.

One alternative to the continual cleaning of the toilet is the use of in-tank articles that dispense a sanitizing agent into the toilet tank. These articles employ a chemical or a combination of chemicals which are activated when in contact with and dissolved in water. Halogens, in particular chlorine bleach, have been used for years in formulations as a santizer and when combined with various surfactants provide a cleaning function as well. These articles have the advantage of providing continuous cleaning and sanitizing of the toilet, at least while the sanitizing agent exists in the system.

If the release of the sanitizing agent is uncontrolled, the high equilibrium concentration of the halogen-containing sanitizing agent may harm the tank and the internal plumbing that is exposed to the halogen-containing sanitizing agent in the tank. In order to control the halogen release rate, thereby preventing damage by high levels of the released chemicals and halogen into the tank, the halogen containing sanitizing agent is usually contained within some type of a dispensing system such as a container or a metering device. Solid lavatory or urinal cleansing compositions are commonly utilized today to clean, deodorize and disinfect toilet water and toilet fixtures. These compositions are typically shaped in the form of "blocks" or "cakes" and are placed by the user in the toilet tank or bowl, or in urinals. The blocks are then designed to slowly dissolve and thereby release part of their active composition over time. It is this time-release attribute which many have found to be invaluable in dispensing functional agents to the water. In many instances, the action of flushing also serves to further dispense the active ingredients.

Solid forms of lavatory cleansing compositions seem to have acquired broader consumer appeal over a diverse array of other product forms such as liquids, powders, and the like. One attribute is their ease of packaging, shipping and handling. Another is their ability to constantly deliver functional material over a specific time period.

The solid forms of lavatory cleansing compositions generally are of two different physical types. One is a containerized cleanser and the other is simply a stand alone tablet in which the entire form disappears upon complete dissolution. The containerized form allows for the release of a metered dose of the active ingredients each time the urinal or toilet is flushed. Here, the container essentially controls the rate of dissolution and release. The stand alone cake on the other hand must be specifically formulated to provide a sustained, controlled release over time. It is the solubility characteristics of the components that make up the block or cake that dictate the rate of dissolution and release over time.

Designing a drop-in product that releases the halogen containing sanitizing agent over a period of several hours is not a difficult task. However, formulation difficulties increase rapidly as the active life of the halogen-containing product is sought to be increased. In addition, the water in the vast majority of toilet systems does not flow continuously so that maintaining a rate of release within a constant range offers additional problems to be overcome. The preferred range of halogen release of a drop-in tablet is from about 0.5 to about 5 ppm. The difficulty in preparing a controlled, substantially constant rate of release of a halogen-containing sanitizing agent, increases exponentially as the useful life is increased beyond an active delivery period of about 1 week. Nevertheless, consumers do not wish to replenish a drop-in lavatory cleaning block constantly. Rather, consumers desire a product that only needs to be replaced after at least about 2 months of use, and preferably after about every 3 to 4 months of use.

There are many different formulations known in the art with respect to both types but all generally comprise a water soluble surfactant, binders, dyes, fillers, odor counteractants and a halogen releasing agent. The stand alone cake formulations will also include one or more hydrophilic or hydrophobic compounds that speed up or slow down the rate of dissolution of the block.

There are numerous instances in the prior art of attempts to regulate the release rate of a halogen containing sanitizing agent, and there have only been varying degrees of success. U.S. Pat. No. 2,863,800 to Gottfried, is directed to a composition for increasing the dissolution rate of 1,3-dichloro-5,5-dimethyl hydantoin (a halogen containing sanitizing agent) in water. The solution for obtaining maximum solubility "within a matter of seconds" disclosed in the patent is the addition of a comminuted wetting agent. One of the formulations comprised 280 parts by weight 1,3-dichloro-5,5-dimethyl hydantoin, 300 parts by weight NaCl, 360 parts by weight $Na_2SO_4$, 50 parts by weight $Na_2PO_4$, and 10 parts by weight of a series of wetting agents. The patent also teaches that the formulation tends to form "wet, gummy masses"... This can only be avoided by the addition of sodium or potassium chloride. Anhydrous sodium sulfate, although a useful material for retarding moistening of the composition during storage, cannot act as a substitute for sodium chloride in the composition.

U.S. Pat. No. 5,178,787 to Hung et al., is directed to a toilet cleaning block that releases a halogen-containing sanitizing agent in a controlled, substantially constant rate for about 2 to about 4 months in water. Although the results obtained by the formulations disclosed are allegedly excellent, the combination of about 4% to about 10% aluminum hydroxide and about 90% to about 96% halogen-containing sanitizing agent is expensive.

The stand alone block or tablet formulations have in the past been formed by melting the various components and then molding the molten cleaning composition in suitable tablet molds to form blocks. Another procedure has been to form a free flowing mixture of the ingredients in particulate form which is then compressed into tablet form on a standard tabletting press.

None of these prior art compositions are free from disadvantages. Regardless of their claims, all of the solid tablet toilet bowl cleaners of the prior art exhibit less than superior rates of dissolution and none exhibit a sustained controlled release that doesn't either affect the tablets cleaning efficacy or require a substantial expenditure of materials, compression and processing capacity.

It is an object of the present invention to provide a method for the preparation and manufacture of a sustained, controlled release solid toilet bowl cleaner that exhibits highly efficacious cleaning capabilities yet is relatively simple to mass produce and use. It is also an object of the present invention to provide a method for the preparation of a solid, sustained release toilet bowl tablet cleaner that is readily formulated and compressed so as to require a lesser expenditure of materials and energy, yet still provide a superior cleaner product.

SUMMARY OF THE INVENTION

An improved process for the compression and tabletting of solid sustained release toilet bowl cleaners comprises the addition of a small amount of an anionic surfactant which produces a suitably compressed tablet with controlled rates of dissolution for long term cleaning efficacy. The surfactant allows for the formation of more tightly compressed tablets which require less compression energy expenditures reducing the wear and tear on commercial large scale tabletting machines.

DETAILED DESCRIPTION OF THE INVENTION

In order to provide long term cleaning efficacy in which the active cleaning ingredients are released in a uniform, controlled rate of dissolution, solid tablet toilet bowl cleaners must either be formulated in a glass or plastic housing which controls the rate of dissolution or if manufactured as a stand-alone must be formulated with a complex variety of hydrophilic agents and delay release materials which add to the expense of product manufacture. The sustained release cleaning tablet of the present invention not only provides sustained, long term release of a highly efficacious cleanser, it is formulated in a simple manner requiring few ingredients which are able to be suitably compressed in a compact tablet form without the need for the expenditure of high compressive forces by the tabletting machine. This contributes less wear and tear on the commercial tabletting machine thereby insuring longer tabletting machine service life.

The addition of a release control material to solid tablet formulations containing halogen release agents as the active cleaner ingredient improves the tabletting process and both regulates the controlled release of the active agent as well as extending the longevity of the tablet's service life. It has been surprisingly and unexpectedly found that the addition of small amounts of an anionic surfactant such as sodium dioctyl sulfosuccinate to a halogen-based cleanser delivers a consistent, efficacious level of chlorine for over four months. This is achieved through the ability to compress a harder cleanser tablet than previously possible at a given compaction pressure.

The pressure under which the cleanser tablet powder is compressed is important since, if the pressure is too low, the tablet components are not tightly bound to a sufficient degree and will tend to dissolve and release the active agents too rapidly resulting in a shortened use life. If the compactor pressure is too high, the tablet tends to dissolve and release the active too slowly ultimately resulting in insufficient cleaning action. The actual pressure that is appropriately employed depends on the components used, their relative proportions and the dissolution rate desired.

Preferably, the solid tablet toilet bowl cleanser of the present invention contains a cleaning/bleaching active consisting of a halogen such as bromine or chlorine. This is combined in a halogen releasing agent. Chlorinated or brominated hydantoin is the halogen release agent of choice and suitable halogen releasing compositions useful in the practice of the present invention include chlorinated hydantoin, N-chlorinated cyanuric acid derivatives such as sodium dichloroisocyanurate, N-chlorosuccinimide, sodium p-toluenesulfochloramine, dichlorosuccinimide, bromochlorodimethylhydantoin, 1,3 dichloro-5-5-dimethylhydantoin, calcium hypochlorite, and mixtures thereof. The bleach is incorporated into the tablet in amounts of from about 50% to 80% by weight based on the total weight of the tablet. Preferably, the bleach component comprises from about 60% to about 70% and most preferably it comprises approximately 65 weight percent of the solid cleanser tablet.

The surfactant that serves as the release control material and surprisingly creates denser, more compacted tablets at decreased tablet pressures is anionic in nature. Suitable anionic surfactants useful in the process of the present invention are selected from the group consisting of the alkali metal salts of alkyl substituted benzene sulphonic acids, alkali metal salts of long chain fatty sulphates, alkali metal ether sulphates derived from alcohols and alkyl phenols, alkali metal sulfosuccinates, alkali metal sarcosinates and alkali metal taurides and mixtures thereof. In particular, sodium dioctyl sulfosuccinate gives excellent tabletting results.

The anionic surfactant need only be incorporated in small amounts to sufficiently provide the tabletting compaction function. Hard, firm tablets were manufactured with the surfactant in amounts ranging from about 2.0% to about 7.0% based again on the total weight of the tablet. Preferably, the surfactant will comprise from about 4.0% to about 6.0% by weight, and most preferably about 5.0% by weight of the total weight of the tablet. The surfactant component may comprise simply one of these compositions or may comprise a mixture of compatible surface active agents. Any of the aforementioned agents may be used, provided of course that they are compatible with each other if used in combination in dry particulate form in the compression process.

A third component that is incorporated in the solid toilet cleanser tablets of the present invention is a particulate slow dissolving filler such as alumina, talc, silica and the like. Alumina, in particular, is used as it serves as a release control agent because its' slow dissolution characteristics give the product a sustained release functionality so that the bleach will be stabilized and slowly released over a four-to five-month period. These generally will comprise from about 10% by weight to about 40% by weight of the total weight of the tablet. Preferably, the not so very water soluble filler will be incorporated in an amount of about 15% by weight to approximately 25% by weight, and most preferably in an amount of about 20% by weight of the total weight of the tablet composition.

An inert salt is also incorporated in the tablet composition as a filler and also functions as a dissolution controller. Since alumina is very slow dissolving, a salt is necessary to enhance the dissolution process of the bleaching tablet. Examples of suitable salts include various alkali metal and/or alkaline earth metal chlorides, sulfates, bromides, citrates, acetates, etc. As is always the case, one skilled in the art must ascertain and will generally know whether and which salt is compatible with the other ingredients of the tablet. Specific examples of suitable salts include sodium chloride, calcium chloride, potassium chloride, calcium sulfate, potassium sulfate, sodium citrate, sodium acetate, sodium bicarbonate, potassium fluoride and mixtures thereof. The preferred salt is sodium chloride and these are incorporated in amounts of about 1.0% by weight to about 20% by weight of the total weight of the composition. Preferably, these are added in amounts of from about 5% by weight to about 15% by weight and, most preferably, in an amount of about 10% by weight of the total weight of the composition.

Tabletting agents may also be added to aid in the compaction process and insure that the solid cleanser tablet is readily released from the die with its integrity maintained. Suitable tabletting agents include soaps such as magnesium stearate, calcium stearates and other soaps, talc, alkali earth metal carbonates, bicarbonates, etc.

Other optional ingredients may be added to the cleanser tablet of the present invention such as germicides, dyes, odor counteractants, diluents, water softeners and the like.

The tablets may also contain inert water-soluble inorganic fillers such as sodium carbonate, sodium bicarbonate, sodium chloride, sodium sulphate, borax, zinc sulphate and the like.

Other ingredients which may be present in the tablets of the invention include water-softening or chelating agents, for example inorganic water-softening agents such as sodium hexametaphosphate or other alkali metal polyphosphates or organic water-softening agents such as the salts of ethylenediaminetetraacetic acid and nitrilotriacetic acid and other alkali metal salts thereof.

Preferably the mixture will contain a total of from 0 to 60%, more preferably 20 to 50% by weight of inert water-soluble fillers, water-softening or chelating agents, water-soluble acids, water-insoluble particulate inert fillers and tablet lubricants.

The process of the present invention comprises the compression of the free flowing dry particulate ingredients hereinbefore mentioned into a block or tablet as is known in the art. The ingredients are first mixed together in their appropriate ratios to make a uniform blend. The mixture is fed into an appropriately shaped die and a compression member is then forced into the die to form a shaped body. Conceivably, the blocks or tablets could also be formed by means of an extrusion process whereby the mixture of ingredients are fed into an extruder which compresses them into a continuous rod of solid composition which is then cut into the appropriately sized pieces.

The addition of the surfactant surprisingly and unexpectedly allows for the production of a more tightly compressed chlorine tablet under the same tabletting pressure as before. This enhances the sustained controlled dissolution rate as well as curtailing the wear and tear of the tabletting machines since less pressure is required to yield a sufficiently compressed tablet.

The following examples are provided to better show the benefits and advantages of the present invention. They are for illustrative purposes only, however, and it is understood that variations and changes made be made with respect to the ingredients used and process parameters employed. In this respect, to the extent that any such changes do not materially alter the final product or process conditions, such changes remain within the sprint and scope of the present invention as recited by the claims that follow.

EXAMPLE 1

In order to illustrate the improved tabletting process and compressed bleach tablet produced thereby, three base bleach cleanser formulations were prepared without the surfactant but different ratios of the other ingredients while one formulation included the compaction enhancer addition. The numbers reflect a weight basis percentage.

| FORMULATION INGREDIENT | A | B | C | D |
|---|---|---|---|---|
| Chlorinated Hydantoin | 65% | 65% | 65% | 65% |
| Alumina | 20% | 10% | 20% | 20% |
| Sodium Chloride | 5.0% | 10% | 5% | 5.0% |
| Sodium Bicarbonate | 10% | 15% | 10% | 8.0% |
| Anionic Surfactant | — | — | — | 2.0% |

Fifty (50) and 100 gram tablets were made of each formulation at the same compaction pressure. Each tablet was then subjected to a stress fracture test to determine how much force or pressure is required to break the tablet. Whereas only 60–70 lbs. were required to break the formations containing no surfactant (A, B, C), 110–138 lbs. were required to fracture the formulation containing the additional surfactant excipient, indicating a more tightly compressed, slower dissolving product.

EXAMPLE 2

Example 1 was repeated with slight changes in the percentages.

| FORMULATION INGREDIENT | B | E | F | G |
|---|---|---|---|---|
| Chlorinated Hydantoin | 65% | 65% | 65% | 65% |
| Alumina | 10% | 20% | 17% | 10% |
| Sodium Chloride | 10% | 5.0% | 5% | 5.0% |
| Sodium Carbonate | 15% | 10% | 8.0% | 15.0% |
| Anionic Surfactant | — | — | 5.0% | 5.0% |

Whereas formulations B and E cracked or crumbled upon the exertion of 60–70 lbs. of pressure, tablets made with formulation F withstood pressures up to between 115–220 lbs. while formulation G tablets did not break until pressures of approximately 110–120 lbs. were exerted. Clearly, the surfactant tabletting aid produces a more tightly compacted tablet which insures long term, uniform dissolution and release of the bleaching agent.

What we claim is:

1. A process for the prepraration of a sustained release, solid toilet bowl cleanser tablet that is twice as hard as similar tablets compacted at the same pressure, said process comprising:

a) mixing a halogen release agent in an amount of from about 50% to about 80% by weight of the total weight of the tablet, an anionic surfactant in an amount of from about 2.0% to about 7.0% by weight, slow dissolving fillers selected from alumina, talc and silica, in an amount of from about 10% to 40% by weight, dissolution controllers selected from the group consisting of alkali and alkaline earth metal salts and other excipients to form a uniform dry particulate blend;

b) feeding said blend to an appropriately shaped die; and c) compacting said blend at a conventional tabletting pressure to form a die-shaped solid tablet.

2. The process of claim 1 wherein said halogen release agent is selected from the group consisting of chlorinated hydantoin, N-chlorinated cyanuric acid derivatives N-chlorosuccinimide, sodium p-toluenesulfochloramine, dichlorosuccinimide, bromochloro-methyl-ethyl-hydantoin, bromochlorodimethyl-hydantoin, 1,3-dichloro-5-5-dimethylhydantoin, alkaline earth metal hypochlorites and mixtures thereof.

3. The process of claim 2 wherein said anionic surfactant is selected from the group consisting of the alkali metal salts of alkyl substituted benzene sulfonic acids, alkali metal salts of long chain fatty sulphates, alkali metal ether sulfates derived from alcohols and alkyl phenols, alkali metal sulfosuccinates, alkali metal sarcosinates, alkali metal taurides and mixtures thereof.

4. The process of claim 3 wherein said dissolution controller is selected from the group consisting of alkali or alkaline earth metal chlorides, sulfates, citrates, bromides, acetates and mixtures thereof.

5. The process of claim 4 wherein said mixture further comprises water softeners.

6. A solid sustained release bleach cleanser made by the process of claim 1.

7. A sustained release chlorine bleach toilet bowl cleanser tablet that is twice as hard as similar tablets compacted at the same pressure produced by the process of:

a) mixing a halogen release agent in an amount of from about 50% to about 80% by weight of the total weight of the tablet formulation, an anionic surfactant in an amount of from about 2.0% to about 7.0% by weight, slow dissolving fillers selected from alumina, talc and silica, in an amount of from about 10% to 40% by weight, dissolution controllers selected from the group consisting of alkali and alkaline earth metal salts and other excipients to form a uniform dry particulate blend;

b) feeding said blend to an appropriately shaped die; and c) compacting said blend at a conventional tabletting pressure to form a die-shaped solid tablet.

8. The cleanser tablet of claim 7 wherein said halogen release agent is selected from the group consisting of chlorinated hydantoin, N-chlorinated cyanuric acid derivatives N-chlorosuccinimide, sodium p-toluenesulfochloramine, dichlorosuccinimide, bromochlorodimethyl-hydantoin, bromochloro-methyl-ethyl hydantoin, 1,3-dichloro-5-5-dimethylhydantoin, alkaline earth metal hypochlorites and mixtures thereof.

9. The cleanser tablet of claim 8 wherein said anionic surfactant is selected from the group consisting of the alkali metal salts of alkyl substituted benzene sulfonic acids, alkali metal salts of long chain fatty sulphates, alkali metal ether sulfates derived from alcohols and alkyl phenols, alkali metal sulfosuccinates, alkali metal sarcosinates, alkali metal taurides and mixtures thereof.

10. The cleanser tablet of claim 9 wherein said dissolution controller is selected from the group consisting of alkali or alkaline earth metal chlorides, sulfates, citrates, bromides, acetates and mixtures thereof.

11. The cleanser tablet of claim 10 wherein said mixture further comprises water softeners.

* * * * *